United States Patent [19]

Lancaster, III et al.

[11] Patent Number: 4,953,336

[45] **Date of Patent: * Sep. 4, 1990**

[54] HIGH TENSILE WRAPPING APPARATUS

[75] Inventors: Patrick R. Lancaster, III; William G. Lancaster, both of Louisville, Ky.

[73] Assignee: Lantech, Inc., Louisville, Ky.

[ * ] Notice: The portion of the term of this patent subsequent to Sep. 19, 2006 has been disclaimed.

[21] Appl. No.: 395,041

[22] Filed: Aug. 17, 1989

Related U.S. Application Data

[63] Continuation of Ser. No. 186,649, Apr. 19, 1988, Pat. No. 4,866,909, which is a continuation of Ser. No. 804,542, Dec. 4, 1985, abandoned, which is a continuation-in-part of Ser. No. 582,779, Feb. 23, 1984, abandoned.

[51] Int. Cl.[5] ..... B65B 13/12

[52] U.S. Cl. ..... 53/556; 53/588; 53/176

[58] Field of Search ..... 53/399, 441, 449, 556, 53/587, 588, 176; 156/428, 430

[56] References Cited

U.S. PATENT DOCUMENTS

| | | | |
|---|---|---|---|
| 4,050,220 | 9/1977 | Lancaster | 53/556 |
| 4,317,322 | 3/1982 | Lancaster | 53/556 |
| 4,418,510 | 12/1983 | Lancaster | 53/441 |
| 4,590,746 | 5/1986 | Humphrey | 53/556 |
| 4,693,049 | 9/1987 | Humphrey | 53/556 |
| 4,711,069 | 12/1987 | Silbernagel | 53/588 X |
| 4,723,393 | 2/1988 | Silberenagel | 53/556 |
| 4,729,205 | 3/1988 | Silbernagel | 53/588 X |
| 4,866,909 | 9/1989 | Lancaster, III | 53/399 |

*Primary Examiner*—John Sipos

*Attorney, Agent, or Firm*—Finnegan, Henderson, Farabow, Garrett & Dunner

[57] ABSTRACT

A film web is dispensed from a film web dispenser and wrapped around a bundle by moving the bundle into an applicator mandrel, revolving the film web dispenser relative to the applicator mandrel, dispensing the film web from the film web dispenser on to the applicator mandrel at a constant supply speed. The film web, wrapped around the applicator mandrel, is transported beyond the downstream end of the applicator mandrel, the bundle is moved beyond the downstream end of the applicator mandrel and the film web is applied from the applicator mandrel onto the bundle so as provide a containment force in the film web after it is applied onto the bundle. A dual stage wrapping system is used in such a manner that each orbiting dispenser is restrained to dispense the film web at a constant supply speed less than the lowest film demand speed at the applicator mandrel and independent of the tension on the film web between the film web dispenser and the applicator mandrel. The applicator mandrel is positioned to resist crushing or disalignment of the bundle or subunits of the bundle within the applicator mandrel and also modifies its position to modify the wrapping cross-section of the bundle so that the web strain elongation varies substantially within a linear wrap force range above the yield point of the stress strain characteristics of the film web between the film web dispenser and the applicator mandrel.

4 Claims, 9 Drawing Sheets

FIG. 26a.
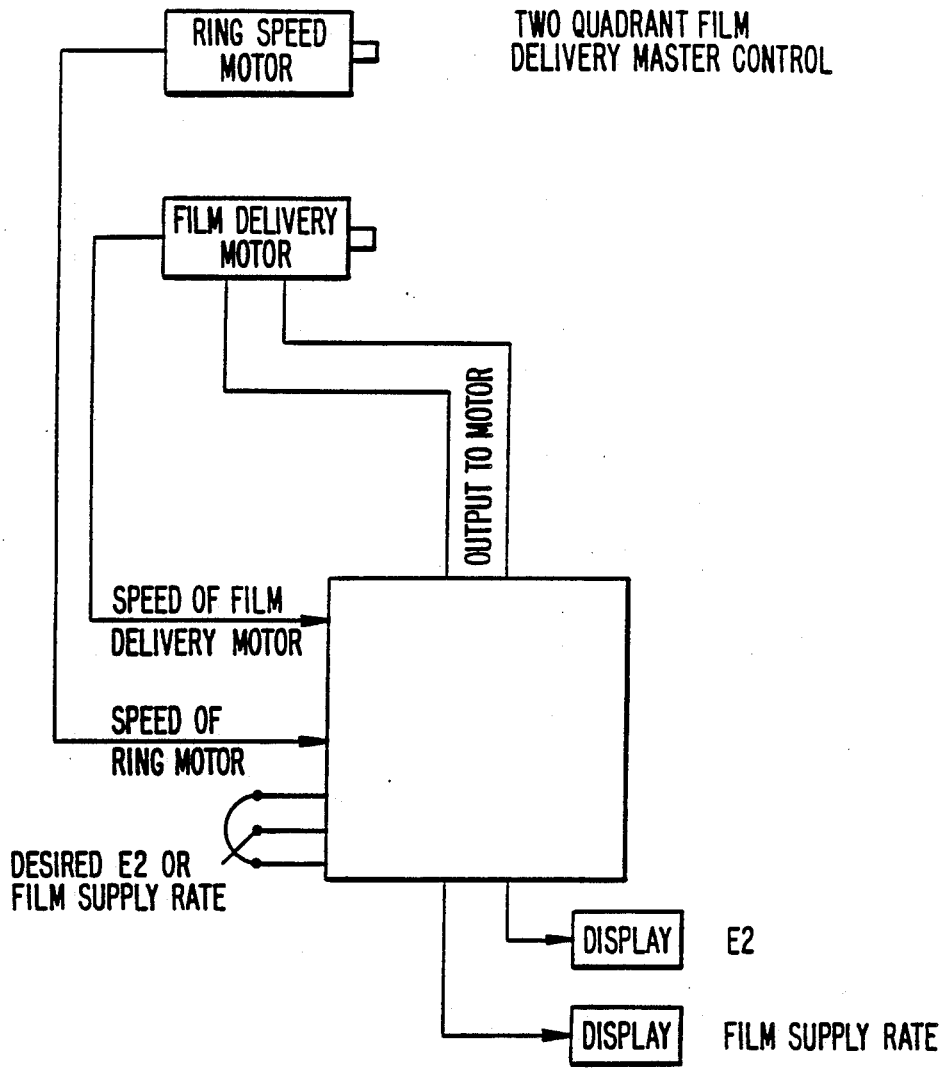
FILM DEMAND = f ( RING SPEED & PRODUCT SIZE)
FILM SUPPLY = f (FILM DELIVERY MOTOR SPEED)
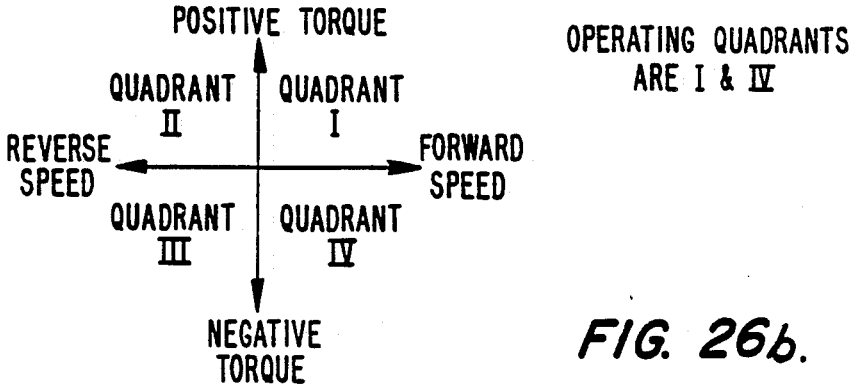
FIG. 26b.

HIGH TENSILE WRAPPING APPARATUS

RELATED APPLICATIONS

This is a continuation of application Ser. No. 07/186,649, filed April 19,1988, now U.S. Pat. No. 9,866,909 which is a continuation of application Ser. No. 06/804,542 filed Dec. 4, 1985 now abandoned which is a continuation-in-part of application Ser. No. 06/582,779 filed Feb. 23, 1984 now abandoned.

BACKGROUND OF THE INVENTION

I. FIELD OF THE INVENTION

The present invention relates to a process for wrapping bundles with stretched film web and more particularly, a process of unitizing a bundle having a plurality of bundle units at extremely high throughput rates with high film web elongation and containment force on the bundles.

II. DESCRIPTION OF THE RELATED ART

It has become popular to package products into bundles by wrapping the products with a web of stretched plastic film. The elasticity of the stretched plastic film holds the products of the bundle under tension while unitizing and covering the bundle.

For a film web wrapping process to be commercially competitive, it has been increasingly necessary to wrap bundles at a very high throughput. This is especially true for business enterprises which need to wrap large numbers of bundles having a uniform cross-sectional shape. The conventional cross-sectional shape is rectangular in order to economize shipping space and facilitate stacking. Due to corner variations which change the effective wrapping radius, bundles having such rectangular cross-sections or other non-circular cross-sections, present a fluctuation in its demand for film web as the film web is wrapped around its periphery.

General Background to Problems With Varying Demand Rates During Wrapping

FIGS. 10–12 show the fluctuation in film demand due to bundle shape variations such as corners. A bundle 40 is centered on axis Y. A film web dispenser 70 is revolved around axis Y at a constant angular velocity and at a constant distance from axis Y to wrap film web 58, moving in direction D around stationary bundle 40. The effective wrapping radius increases from A to B during the progression between FIGS. 10 and 11 and decreases to radius C between FIGS. 11 and 12. The effective wrapping radii A, B, and C extend between center of revolution Y and tangent T, and if rotated, form circles J, K, and L, respectively.

Under constant angular velocity of film web dispenser 70, the film web demand rate is proportional to the effective wrapping radius. FIG. 10 shows a minimum demand rate where the wider side of an oblong bundle has just been wrapped. FIG. 11 shows a maximum demand rate where the film engages a corner. FIG. 12 shows a secondary minimum demand rate where the narrower side of an oblong bundle has just been wrapped. This secondary minimum demand rate is less than the maximum demand rate shown in FIG. 11, but greater than the minimum demand rate shown in FIG. 10 because effective radius C is greater than effective radius A due to the oblong shape of the bundle.

The relation between demand rate or speed and time is shown in FIG. 5. The maximum demand rate or speed existing at the corners in the condition shown in FIG. 11 is indicated by maximum points 154 in FIG. 5. Minimum demand rates or speeds in the positions shown in FIGS. 10 and 12 are indicated by minimum points 152 in FIG. 5.

If film web 58 is dispensed from film web dispenser 70 at a constant supply rate such as that shown in FIG. 6, the film web stretched between film web dispenser 70 and bundle 40 would follow a pattern of elongation over time that would be similar to the pattern of the demand rate over time. Such a pattern of elongation over time is shown in FIG. 7. This elongation pattern of FIG. 7 is similar to the demand rate pattern shown in FIG. 5. Elongation maximums 144 correspond to demand rate maximums 154. Elongation minimums 142 correspond to demand rate minimums 152.

During wrapping, bundle edges isolate tension on each film web segment applied to a bundle surface from film web segments applied to adjacent surfaces. The effective containment force on the bundle is locked in just as it covers a bundle surface in the positions shown in FIGS. 10 and 12. Therefore, the locking in of containment force occurs where the demand rate and force on the film is lowest in the wrapping cycle.

It can be appreciated that in the arrangement shown in FIGS. 10–12, when the bundle is off-center relative to rotation axis Y, the demand rate and wrap forces would fluctuate even more widely between a maximum and a minimum for each side of the bundle due to greater variations in the effective wrapping radius.

Within the context of this varying demand rate due to bundles with a non-circular cross-section, efforts were made to control the rate at which the film web is dispensed from the film web dispenser to provide a sufficient containment force due to stressed film web on the wrapped bundle while preventing film rupture at excessively high stresses. A varying film web demand rate creates the adverse situation that the film stress-strain maximum must not rupture the film, while the stress-strain minimum is the containment force locked in after wrapping. In order to have any containment force, the minimum must exceed zero stress.

Demand Force Controlled Supply Rate Systems

At slow film web supply rates, the force on the film web between the film web dispenser and the bundle generally proportional to the varying demand rate. Therefore, early film web dispensers controlled the supply rate of the film web by measuring the force on the film web. Then they varied the film web supply rate of the dispenser accordingly so that the supply rate of the film web from the dispenser followed the demand rate for the film web caused by the corner variations of the bundle. By maintaining a constant force on the film web, the stress-strain values for the film web could be kept constant over time and therefore maintain a high containment force while preventing an increase in force due to fluctuations in demand rate which would rupture the film. The demand, supply, and force curves of this control arrangement are seen in FIGS. 23, 24 and 25.

However, there are major drawbacks in controlling film web dispenser supply rates by the sensing of variations in force on a film web due to the varying demand rate of a non-circular cross-sectioned bundle. The first drawback is that any imperfection such as a hole in the film web reduces the area over which the force is applied This dramatically increases the stress on the remaining cross-sectional area of the film web. The hole is further elongated and enlarged because the control system automatically decreases the supply speed at the dispenser. This growing difference between the supply and demand speeds finally ruptures the film.

The second drawback occurs when the film web is dispensed at higher speeds in an attempt to increase throughput. The inertia of the film dispenser and the elasticity of the film web between the film web dispenser and the bundle cause a phase delay or lag in supply speed changes relative to demand speed changes This phase delay has its worst drawbacks when the supply rate lags the demand rate such that the supply rate is increasing while the demand rate is decreasing and the supply rate is decreasing while the demand rate is increasing. Rather than equalizing the force on the film over time due to the variations in demand rate, such a phase delay causes a heightened variation in force and elongation on the film web, thereby rupturing the film web.

Speed Controlled Supply Rate Systems

A second type of control for varying the supply rate of the film dispenser due to the variations in demand rate was developed in order to overcome the drawbacks of the force controlled dispensing system. This system, rather than sensing force in the web, was designed to vary the supply rate of the film web according to the known supply rate which would be required to meet the instantaneous demand rate at each position of the film web dispenser's revolution about the bundle. By not sensing force, the film web was not ruptured due to the drawbacks caused by its imperfections. In addition, phase delay drawbacks were avoided at somewhat higher speeds. However, as the speed of the film web dispenser was further increased, an inordinate amount of power was required in order to more quickly accelerate and deaccelerate the film web supplied from the film web dispenser. Therefore, film web dispensers which controlled supply rate according to dispenser position were unable to attain high film web supply speeds as well.

Stress-Strain Characteristics of Film Webs

As shown in FIG. 8, film webs exhibit a stress-strain curve having a steep initial linear portion 140E where elastic behavior is present and a gradual second linear portion 140P where plastic behavior is present. In between these two linear ranges is an intermediate range or region on the stress-strain curve commonly known as the yield point 141. It is in the range of this yield point that the stress-strain behavior of the film web changes between substantially elastic to plastic. Film webs stretched above yield point gain significantly in modulus and ultimate strength. For instance, a low density polyethylene film web will increase its ultimate strength in pounds per square inch of cross-sectional area by 300% after being elongated approximately 300%. Therefore, current stretch wrapping operations use prestretch subsystems in the film web dispenser as a matter of course.

Stress-strain curves are dependent upon the end conditions of the film web and the previous history of stress and strain in the film web. For example, in the arrangement shown in FIG. 10, the stress-strain curve of the film web between closely spaced rollers a and b in the pre-stretch subsystem of the film web dispenser 70 is different although generally similar in shape to the stress-strain curve of the film web between the more greatly spaced downstream roller b and bundle 40.

If an unstretched film web is stretched from the point of origin 0 along the elastic portion 140E of the stress-strain curve to a point no further than yield point 141, the film web will return to a stress-strain condition along the same curve 140E when the stretch force is reduced or removed, and will once again have zero strain at zero force.

However, if the film web is stretched beyond yield point 141 so that it reaches a point on the plastic portion 140P of the curve such as point 148, the film web behavior after the force is reduced or removed will be to progress down curve 150 rather than returning back along curve 140P and 140E. If the force is now totally removed, the film web will exhibit a permanent positive elongation indicated by point 160.

Prestretch Devices

In seeking to decrease the amount of film web needed for a given containment force, pre-stretch devices were developed to pre-stretch the film web in the film web dispenser under controlled conditions between closely-spaced rollers which rotated at a constant ratio. Such pre-stretching produced a permanently elongated film with good strength characteristics. As shown in FIG. 10, film web dispenser 70 includes a pre-stretch system having upstream roller a and downstream roller b which isolate the film web from the demand rate variances generated by the bundle. Upstream roller a is conventionally connected to downstream roller b by a constant ratio gear train with a mechanical advantage which causes downstream roller b to rotate faster than upstream roller a and thereby stretch the film web between rollers a and b.

However, conventional attempts to increase the force on the film between the film web dispenser and the bundle resulted in breaking the film web. Therefore, in order to avoid rupturing the film web after pre-stretching it in the film web dispenser, it has been conventional to supply the film web from the dispenser to the bundle at a supply rate greater than the maximum demand rate at the bundle so that the film web recovers or reduces its elongation to a value less than the elongation provided by the pre-stretch device in the supply direction. In addition, the wrap force, or force on the film web between the film web dispenser and the bundle, is conventionally maintained at a value less than the pre-stretch force, or force on the film web between the rollers in the pre-stretch device of the film web dispenser. Under such conditions, the film web would elastically recover to a point along recovery curve 150 after being pre-stretched to point 148. Therefore, the wrap force on the film web between the film web dispenser and the bundle conventionally varied between a minimum 142 and a maximum 143 on recovery curve 150 due to fluctuation in demand rate caused by a non-circular bundle.

In order to keep the film web between the film web dispenser and the bundle at a stress-strain condition along recovery curve 150, a number of systems have been developed which use a motor which supplied a positive torque to downstream roller b of the pre-stretch device. The motor had the effect of driving the film forward from the film web dispenser. Such motors and their control systems have had the capability of controlling the minimum film web supply speed by increasing supply speed if it were to fall below a predetermined minimum supply rate. However, they have not had the capability of controlling the maximum film web supply speed because it was not thought to be necessary. With such motors and control systems, if high supply speeds were attempted, the motors would be driven by the film faster than their set maximum constant supply speed. This set up an overrun condition, described below, which destroyed the film web.

Therefore, even though the pre-stretch approach achieved more precise and effective elongation performance than rudimentary braking devices which were originally used to stretch the film, and although greater film web economies and improved containment reliability was increased by reducing high forces to the bundle, the throughput and usefulness of the pre-stretch approach has also been limited by the variation and forces caused by the contours of a non-circular bundle cross-section.

Film Speed Limited: Drawbacks of Other Conventional Demand Force Controlled Supply Rate Systems U.S. Pat. Nos. 4,302,920 and 4,317,322 disclose pre-stretch dispensers in which changes in the demand rate due to corner variations of a non-circular load are transmitted directly through the film to the dispenser to vary the dispenser supply rate according to the bundle demand rate. U.S. Pat. Nos. 4,387,548, 4,387,552 and 4,524,568 disclose the use of constant positive torque supply motors which drive the film web forward to reduce the force and elongation on the film web between the dispenser and the bundle after it has been pre-stretched. U.S. Pat. Nos. 4,503,658 and 4,514,955 disclose the use of varying positive torque supply motors which drive the film web forward to reduce and unify over time the force and elongation on the film web between the dispenser and the bundle after it has been prestretched. However, all these systems are inoperable at high speed throughput such as film web dispenser angular orbit velocities above around 25 revolutions per minute. This limitation is due to the drawbacks of demand force controlled supply systems including destruction of film web due to imperfections and phase shift effects.

Film Force Limited: Drawbacks of Other Conventional Speed Controlled Supply Rate Systems U.S. Pat. No. 4,418,510 discloses the use of a constant positive speed control motor which drives the downstream roller of the film dispenser at a supply rate in excess of the demand rate for the film by the bundle. This system avoids the drawbacks of the force demand controlled supply systems of web hole expansion and phase lag. However, if the film web were stretched at a sufficiently high force and elongation rate, the motor, rather than positively driving the film web forward, would need to restrain the film web. Since no provision exists in conventional motor system and their control systems to prevent the motor from exceeding its set predetermined supply speed, if it is so drawn by the film web, the internal inerta and friction of the motor would be acting in an uncontrolled way as a brake on the film web.

Rather than driving the film web forward, the motor supply speed would be overrun by a film web speed that was faster than the set constant supply speed of the motor. The motor would be driven by the tension in the film web between the dispenser and the bundle in a demand force controlled way which varies the supply speed of the dispenser in response to varying the demand speed of the bundle.

In effect, the control of the dispenser supply rate would be converted to a demand force controlled supply rate system with the attendant problems of such systems, namely destruction of film web due to imperfections and phase lag which prevent operation at high throughput speeds.

Such overrunning of the positive speed supply motor would occur at stress-strain conditions above yield point of the film web between the dispenser and the bundle. Therefore, this would prevent a conventional system from operating at such stress-strain conditions above yield point.

One can tell when the motor is being driven by the film web rather than driving the film web as intended by convention systems by analyzing whether a system is being overrun.

If higher than conventional wrap forces were attempted in a positive torque supply motor control pre-stretch system, the film web alone would drive the rollers of the pre-stretch system and the positive torque motor would be driven by the pre-stretch system at speeds higher and more varying than the intended motor speed. The film web overdrives the motor and causes it to act in an uncontrolled way as a brake when the wrap force $F_2$, between the film web dispenser and the bundle, is related to the prestretch force $F_1$ between the pre-stretch rollers according to the following relationship:

$$F_2 = F_1 * (1 - R_S/R_L)$$

where $R_S$ is the radius of the downstream roller gear and $R_L$ is the radius of the upstream roller gear. In order to have prestretch, stretch, $R_S$ is always less than $R_L$ so that the term $(1 - R_S/R_L)$ is always positive and less than 1, and an overrun force $F_2$ is less than $F_1$. For example, if $R_S/R_L = \frac{1}{3}$, a conventional value, then $F_2$ equals $\frac{2}{3} * F_1$ when overrun occurs.

In summary, when overrun occurs, the supply rate of the film web from the film web dispenser is dependent on the force of the film web between the film web dispenser and the bundle Such a system suffers from the drawbacks of force controlled dispensers discussed above, namely, rupture of films with imperfections and problems with phase lag which prevent high throughput operation.

Film Force Limited: By Grossness of Load and Point Force From Load

The Kaufman Company Stretch Command III pre-stretch pallet load wrapping system also used a constant positive speed control motor on the film web dispenser. Although the pallet was rotated at a constant angular velocity, corner variations caused a varying demand rate which varied over a very wide range due to the great size of the pallet. The film web supply speed and force on the film web had to be limited to a narrow range to avoid crushing the pallet load or losing containment from some sides of the pallet load. Therefore, high wrap forces are impossible.

Also, the corners of the pallet load and the corners of the individual units making up of the pallet load, when wrapped with the film web would create a point force loads, on the film web which cause rupture of the film web at high film web wrap forces.

Finally the Kaufman motor would suffer the same overrun problems, discussed above, if high wrap forces could otherwise be attained despite the grossness in load problems. Such overrun problems would have occurred if the supply speed was substantially lower than the highest demand rate.

The Anderson Company pallet wrapper, introduced at the 1978 Chicago PMMI Show and illustrated as prior art in U.S. Pat. No. 4,503,658, interconnected the film web supply with the pallet turntable with a variable transmission. Constant film web supply speed could be attained and no demand force controlled overrun problems would occur. However, the grossness of load and point source load problems prevented speed and force operation outside the same range as Kaufman. Even if these problems could be overcome, high wrap forces would prevent an effective operation by dislodging the pallet load from its position.

Film Force Requirements: Use of Conveyors and Other Bundle Supports

Conveyors and other bundle supports have been used in bundle wrapping in order to transport and support the bundle during wrapping. An example of such a system is shown in U.S. Pat. No. 4,317,322. However, conveyors and other bundle supports increased the cross-sectional wrapping area since they were positioned on the outside of the bundle. When using conveyors and other supports, the film web would have to additionally recover against the bundle after the bundle had been moved off of the conveyor because of the cross-sectional area of the bundle relative to the conveyor and the supports.

The film force limitations of the conventional systems discussed above are even more critically limiting when used with conveyors and other bundle supports. This is because even greater force on the film web is required to wrap the bundle on the conveyor and support so that adequate containment force would be available subsequent to film web recovery onto the bundle from the conveyor and bundle supports after the bundle had been removed from the conveyor and supports after wrapping. However, in order to avoid bundle collapse during wrapping, the force to the bundle conventionally was minimized and the recovery of film against the bundle produced a substantially reduced containment force.

Film Force Limited: Problems With Multiple Unit Bundles

Multiple unit bundles consist of a number of individual units, with each unit being a box or carton such as one which is ultimately delivered to the consumer The units may be stacked both across the width, length, and height of the bundle. Such bundles of individual units have practically no internal structural strength since the friction between the units is minimized by their shape, mass and container surface characteristics. Therefore, it has been significantly difficult to wrap a bundle of these individual units with a film web at a wrap force which is sufficiently high to result in a containment force on the bundles while not skewing the bundles either during or after the wrapping process. However, multiple unit bundles also have a special requirement for a containment force which is high enough to form a tight bull's-eye pattern in the film at the ends of the bundle. A tight bull's-eye means smallness of size of the aperture defined by the film ends on the ends of the bundle after wrapping, and tightness on the film web on the bundle ends. Although this is desirable on any wrapped bundle, it is especially desirable and necessary on bundles having multiple units to prevent the units from falling out of the bull's-eye or shifting.

Film Force Limited: Problems With Crushing

The regulation of wrap force has also been a problem with fragile crushable bundles. Since only the minimum force is locked into the wrapped film web due to the varying demand rate of a non-circular cross-sectioned bundle, such bundles must be wrapped with a sufficiently high wrap force in order to have a sufficiently high containment force. However, the wrap force also needs to be sufficiently low such that the packages will not be crushed. The result of this situation is that crushable bundles conventionally are often crushed during wrapping or are wrapped in film web which provides insufficient containment force.

Film Force Limited: Problems With Bundles Having Oblong Cross-Sections

There is a further aggravating factor in conventional film wrapping systems which reduces containment forces on bundles having oblong cross-sections. A film web segment applied to any side of a bundle exhibits elongation and force independent of the contiguous film web applied to either of the surfaces wrapped immediately prior to or after the given side. This is because bundle edges isolate tension on each film web segment applied to a surface from connecting film web segments applied to adjacent surfaces. Since slippage and tension equalization across edges does not occur, extreme tension differences exist between the consecutive segments of a wrapped bundle having an oblong cross-section. Further, since the locking in of forces occurred where the film web had recovered to a minimum elongation, only the minimum containment characteristics are locked into the film web.

SUMMARY

In summary, conventional wrapping systems suffer from many drawbacks.

It has been difficult to obtain a high throughput speed, high film dispenser orbit speed and high film dispensing speeds due to difficulties in controlling supply of the film web from the film web dispenser.

It has been difficult to prevent film rupture due to the grossness of load, point source loading due to corners of a bundle, and uncontrolled high stresses due to uncontrolled operation of pre-stretch systems due to overrun.

It also has been difficult to obtain high containment forces on the wrapped bundle due to the use of conveyors and other supports for the bundle due to recovery of pre-stretch elongation which occurred between the film web dispenser and the bundle during wrapping.

It has been further difficult to obtain high containment forces on the wrapped bundle because of the difficulties in properly positioning and orienting of the bundle relative to the wrapping system.

It has been difficult to prevent the bundle and subunits of the bundle from being dislodged from the wrapping position due to the high wrapping force on the film web which is required to produce an adequate containment force on the bundle.

It has been difficult to prevent crushing of the bundle during wrapping due to the wrapping force required in the film web to produce an adequate containment force on the bundle.

It has been difficult to prevent great changes in stress on the film dispenser and film web during wrapping due to varying demand rates caused by film web demand variations in a non-circular cross-sectioned bundle.

It has been difficult to obtain a high wrap force due to bundle sensitivity and difficulties in controlling film supply.

It has been difficult to obtain high elongation of the film web during wrapping for efficient use of the film web while obtaining high containment forces without rupturing the film.

It has been difficult to equalize locked-in forces in the film web when wrapping oblong bundles.

It has been difficult to apply wide film web while minimizing wrinkles in the film web after it has been applied to the bundle.

It has been difficult to obtain, due to lack of adequate containment force, a tight bull's-eye pattern in the film at the ends of the bundle.

In view of these difficulties with conventional systems there are a variety of objects which the present invention seeks to achieve.

It is a further object of the present invention to obtain a high throughput speed, high film dispenser orbit speed, and high film dispensing speeds by effectively controlling supply of the film web from the film web dispenser while providing high film web containment force on the bundle after wrapping.

It is an object of the present invention to prevent film rupture due to the grossness of load, point source loading due to corners of a bundle, and uncontrolled high stresses due to uncontrolled operation of pre-stretch systems due to overrun.

It is an object of the present invention to obtain high containment forces on the bundle while using conveyors and other supports for the bundle.

It is another object of the present invention to obtain high containment forces by properly positioning and orienting of the bundle relative to the wrapping system.

It is also an object of the present invention to prevent the bundle and subunits of the bundle from being dislodged from the wrapping position due to high wrapping force on the film web which is required to produce adequate containment force on the bundle.

It is a further object of the present invention to prevent crushing of the bundle during wrapping due to the wrapping force in the film web which is required to produce an adequate containment force on the bundle.

It is another object of the present invention to prevent great changes in stress on the film dispenser and film web during wrapping due to varying demand rates caused by film web demand variations in a non-circular cross-sectioned bundle.

It is an additional object of the present invention to obtain a high wrap force due to bundle sensitivity and difficulties in controlling film supply.

It is also an object of the present invention to obtain high elongation of the film during wrapping for efficient use of the film web while obtaining high containment forces without rupturing the film.

It is also an object of the present invention to equalize locked in forces in the film web when wrapping oblong bundles.

It is an additional object of the present invention to apply wide film web while minimizing wrinkles in the film web after it has been applied to the bundle.

It is another object of the present invention to obtain a tight bull's-eye pattern in the film at the ends of the bundle.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the purposes of the invention as embodied and broadly described herein, there is provided a process for wrapping a bundle with a film web dispensed from a film web dispenser comprising moving a bundle into an applicator mandrel, revolving the film web dispenser relative to the applicator mandrel, dispensing the film web from the film web dispenser onto the applicator mandrel at a constant supply speed, transporting the film web wrapped around the applicator mandrel beyond the downstream end of the applicator mandrel, continuously moving the bundle beyond the downstream end into the applicator mandrel, and applying the film web from the applicator mandrel onto the bundle so as to provide a containment force in the film web after it is applied onto the bundle.

It is preferable to restrain and retard the film web being dispensed by the film web dispenser. It is also preferable to dispense the film web from the film dispenser at a dispenser supply speed less than the lowest demand speed at the applicator mandrel.

It is pre-stretch the film web beyond its pre-stretch yield point to plastically deform the film web in a film dispenser and subsequently post-stretch the film web in the linear stress-strain range beyond its post-stretch yield point to plastically deform the film web between the film web dispenser and the applicator mandrel throughout the revolution of the film web dispenser.

It is preferable to position an oblong cross-sectioned bundle having a wider side and a narrower side in the applicator mandrel and supporting the film web on the applicator mandrel so that the cross-section of the supported film web is less oblong and more square than the bundled cross-section.

It is preferable to prevent the application of substantial point loads to the film web from the applicator mandrel and supply a substantially uniform force across the full web width of the film web while dispensing the film web onto the applicator mandrel.

It is preferable to maintain the film web within a stress-strain variation range wherein film web stress undergoes minimal variation while film web strain undergoes comparatively greater variation throughout the revolution of the film web dispenser while the film web is positioned between the film web dispenser and the applicator mandrel.

It is preferable to dispense a first film web in a first helical direction having a first circular component and a second film web on a second helical direction having a second circular component opposite to the first circular component.

BRIEF DESCRIPTION OF THE DRAWINGS

The accompanying drawings, which are incorporated in and constitute a part of the specification, illustrate a preferred embodiment of the invention and, together with the general description given above and the detailed description of the preferred embodiment given below, serve to explain the principles of the invention.

FIG. 26 is a diagram of a motor speed controller with regenerative capabilities which are arranged according to the present invention.

DESCRIPTION OF THE PREFERRED EMBODIMENTS

Reference will now be made in detail to the present preferred embodiment of the invention as illustrated in the accompanying drawings.

The wrapping process of the present invention will be described as being performed on the dual-dispenser apparatus and also shown in FIGS. 1–4 described in copending application Ser. No. 582,779.

Figure 1:
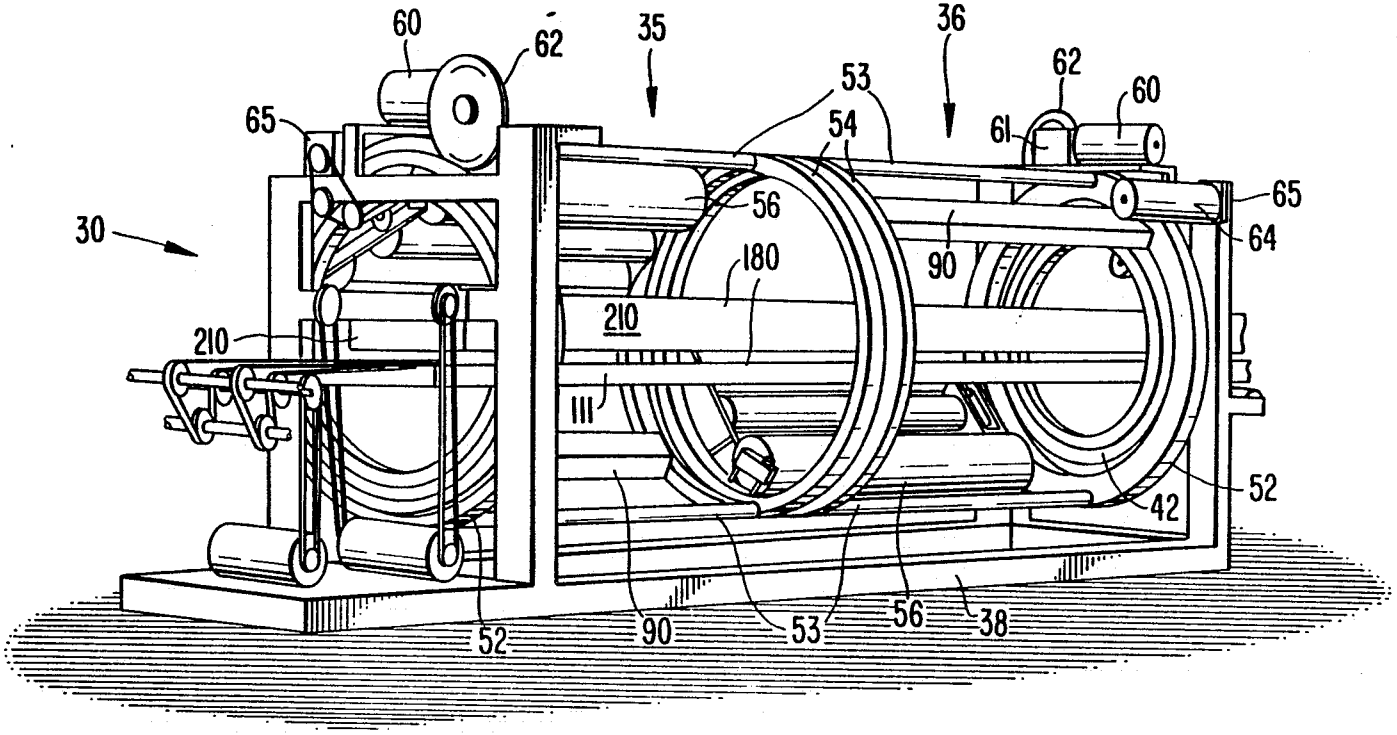
FIG. 1 is a perspective view of a dual-stage wrapping apparatus capable of performing the process of the present invention.
Figure 2:
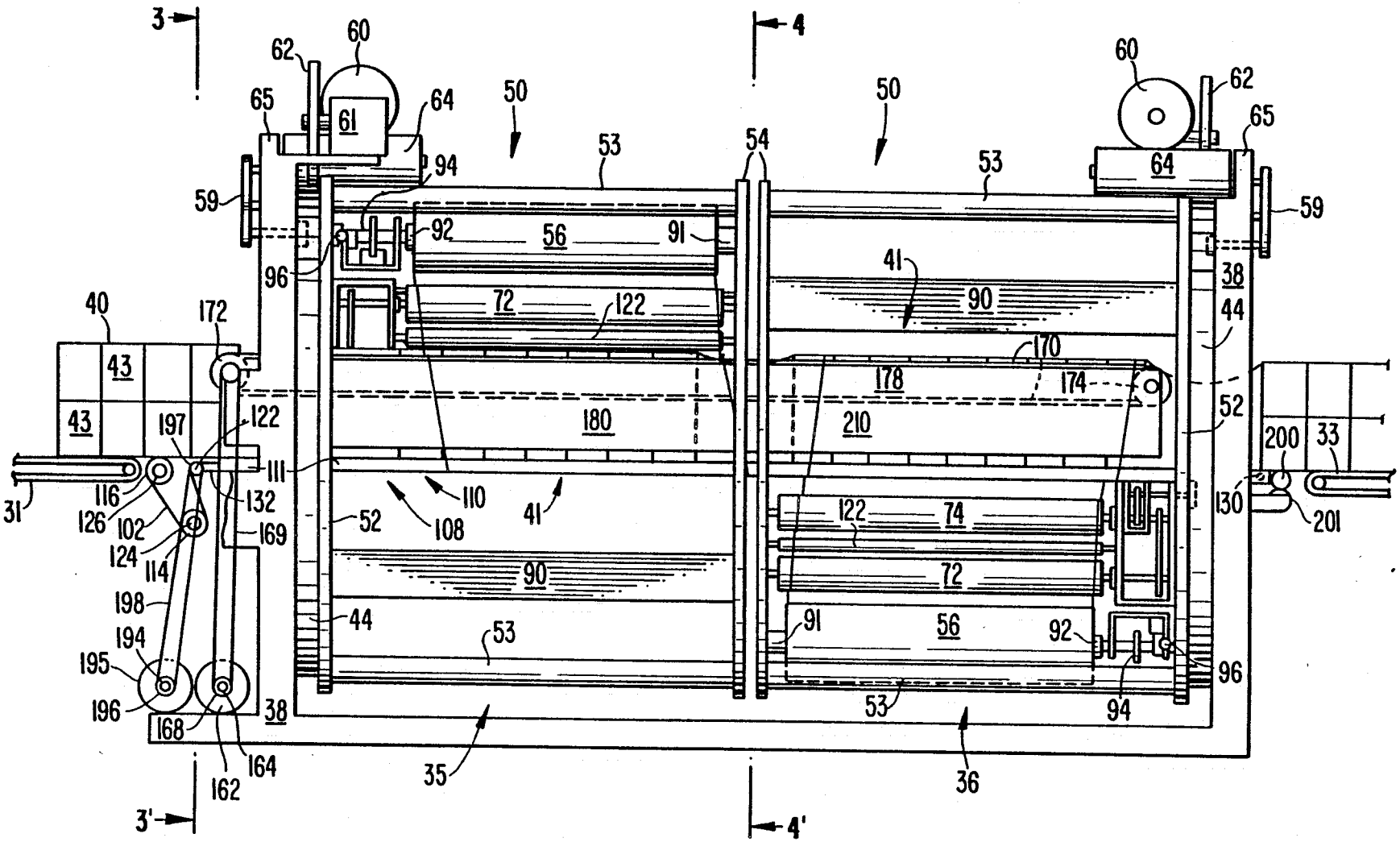
FIG. 2 is a side view of the apparatus of FIG. 1.

As shown in FIG. 2, a plurality of units 43 forming bundles 40 have been loaded in stacked relationship on an infeed conveyor assembly 31 either manually or mechanically. As an alternative to the conveyor, descending freewheel rollers or a pneumatic or hydraulic pushing device can be used to engage and push each bundle 40 into the wrapping area.

An upstream wrapping stage 35 and a downstream wrapping stage 36 are mounted to frame 38. Each wrapping stage includes a dispenser barrel 50 for revolving a film roll 56 and a film web dispenser around a bundle 40. The film web dispenser includes elongation mechanism 70. The dispenser barrel 50 includes a mounted hoop 52, a free hoop 54, and a plurality of barrel tubes 53 joining hoops 52 and 54 so that they are coaxial and parallel to one another.

Figure 3:
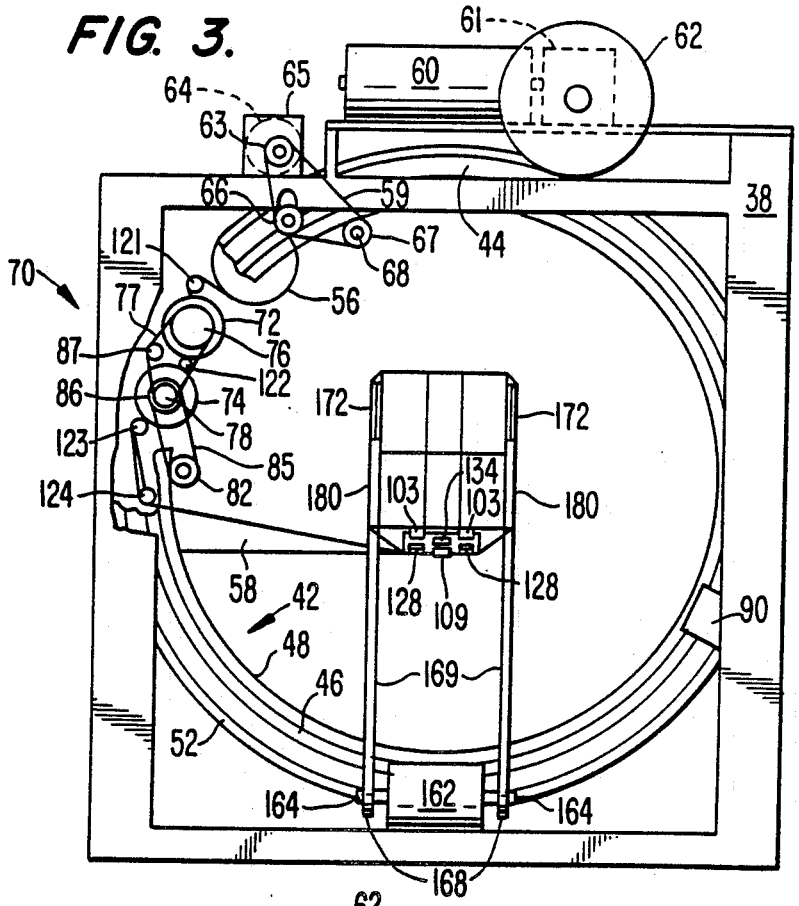
FIG. 3 is a front cutaway view taken along line 3—3' of FIG. 2.

As shown in FIG. 3, mounted hoop 52 is bolted or otherwise fixed coaxially to the outermost race 44 of a circular triple bearing race 42. The middle bearing race 46 of a triple race 42 is fixed to the frame 38, and the innermost race 48 is freely driven to rotate for purposes which will be described below. A dispenser motor 60 is mounted to the frame and coupled through right angle reducer 61 to drive friction wheel 62 which is in contact with outer race 44. Thus, operation of motor 60 will rotate friction wheel 62, outer race 44 and dispenser barrel 50.

Figure 4:
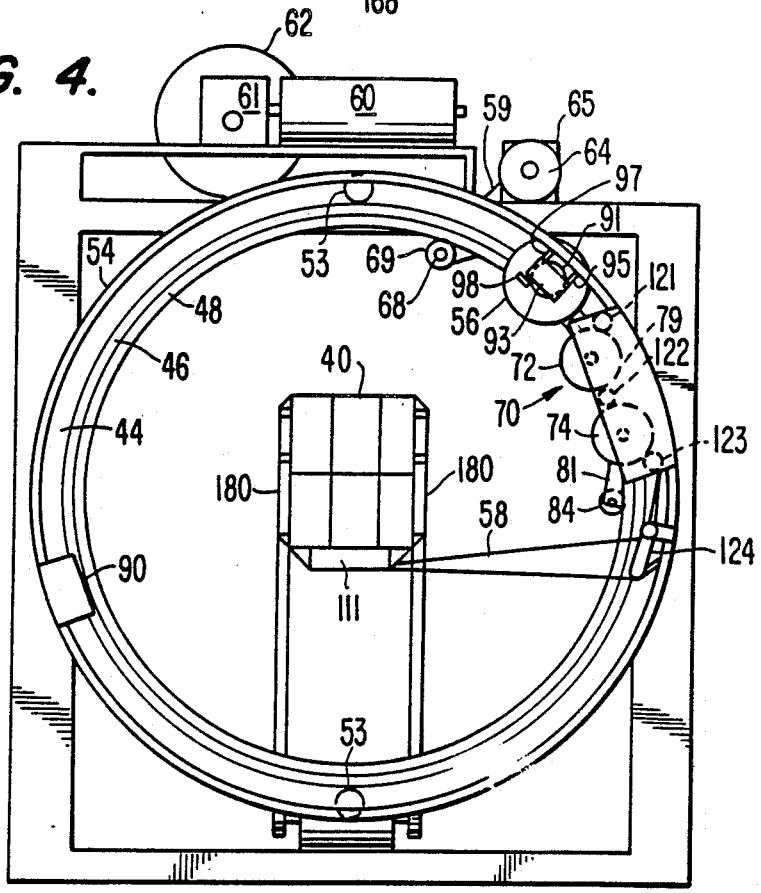
FIG. 4 is a rear cutaway view taken along line 4—4' of FIG. 3.

Elongation motor 64 is coupled through reducer 65 to reducer pulley 63. A belt 59 surrounds pulley 63, tension pulley 66, and drive pulley 67. Drive pulley 67 is mounted on shaft 68 which in turn is mounted to the frame 38 and extends inside the inner race 48. As shown in FIG. 4, friction roller 69 contacts inner race 48 and is mounted to shaft 68. Therefore, operation of motor 64 will drive the belt 59, the pulley 67, friction roller 69 and inner race 48.

The film web dispenser elongation mechanism 70 and film roll 56 are mounted on the dispenser barrel 50 opposite a counterweight 90. The elongation mechanism 70 includes an upstream roller 72 and downstream roller 74 which are driven by elongation motor 64 to rotate at respective fixed constant surface speeds. Film web 58 is drawn from roll 56 across the surface of the upstream roller 72 rotating at a first constant speed and then across the surface of the downstream roller 74 rotating at a second constant speed higher than the first constant speed. The film web 58 is stretched between the upstream and downstream rollers 72 and 74 at a constant stretch ratio corresponding to the ratio of the speeds of the upstream and downstream rollers 72 and 74. For film webs which are currently popular, the stretch ratio is preferably in the range of 1:2 to 1:3.

As shown in FIG. 2, core hubs 91 and 92 are mounted adjacent to each of the hoops 52 and 54 to engage the hollow core of film roll 56 and maintain film roll 56 rotatably mounted on the dispenser barrel 50. Core hub 92 and disk brake 94 are pivotally mounted to the hoop 52 by hinge 96. Brake 94 engages the hub 92 and restrains the hub 92 from free rotation. This prevents rapid spillage of film web 58 from film roll 56 during shutdown of the wrapping operation. Brake 94 also prevents slack on the web between roller 56 and roller 72 as film payout reduces the diameter of film roll 56.

As shown in FIG. 4, core hub 91 is mounted to swing plate 93 which pivots across the plane of hoop 54 on pivot shaft 95 journalled to hoop 54. At an end of swing plate 93 opposite shaft 95, a locking pin 97 is removably engaged with hoop 54. It may be engaged by spring pressure to enter a blind bore of hoop 54, or by being threaded to a threaded bore of hoop 54. Handle 98 is coupled to pin 97 for manual release of pin 97 from the hoop 54 when film roll 56 is completely dispensed. Plate 93 and core hub 91 may then be swung away from the roll core about shaft 95, and the core may be tilted outward from the hoop 54 on the hinge 96, shown in FIG. 2. The roll core then may be removed easily by hand and a fresh film roll 56 may be mounted by engaging one end of the roll core to hub 92, swinging the roll inward, and closing swing plate 93 to engage hub 91 with the core of the roll 56. Pin 97 then is locked into the hoop 54 to maintain new film roll 56 in place.

Figure 13:
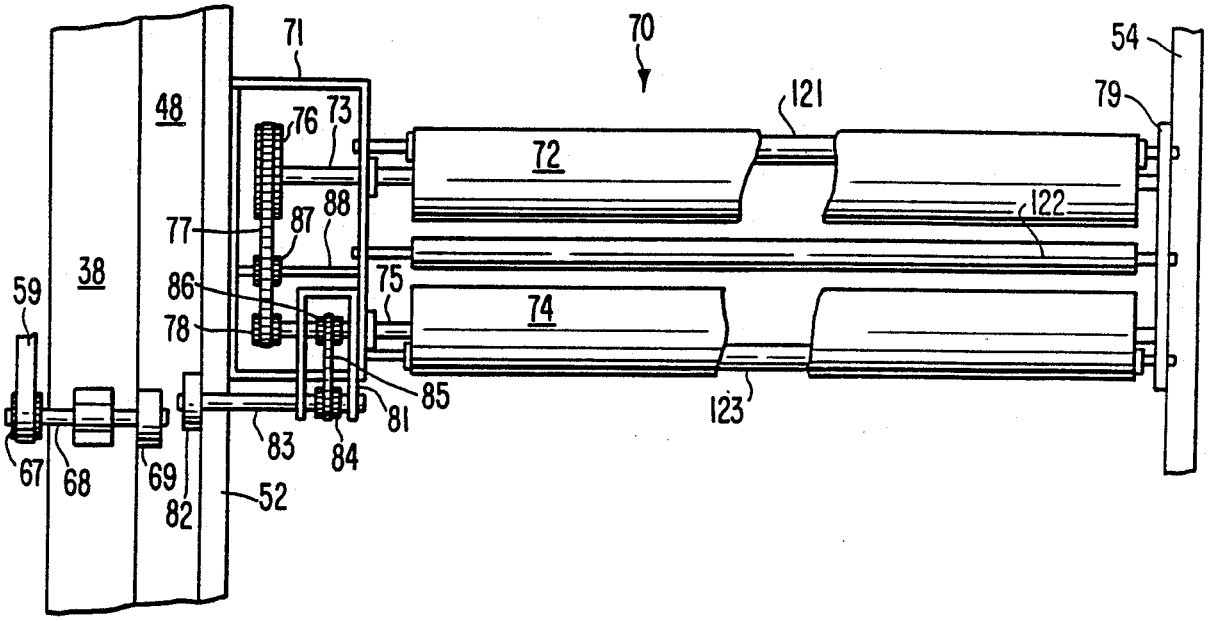
FIG. 13 is an isolated side view of an elongation mechanism of the apparatus of FIG. 3.

As shown in FIG. 13, upstream roller 72 is mounted on upstream shaft 73 one end of upstream shaft 73 is journalled to support plate 79 on hoop 54. The other end of upstream shaft 73 passes into a transmission housing 71. Downstream roller 74 is mounted on downstream shaft 75. One end of downstream roller 74 is journalled to plate 79 and the other end passes through the transmission housing 71. An upstream gear 76 is mounted to upstream shaft 73 in housing 71. A downstream gear 78, smaller than upstream gear 76, is mounted to downstream shaft 75 and is coplanar with upstream gear 76. The ratio of gears 76 and 78 preferably is in the range of 2:1 to 3:1. Additionally, a tension shaft 88 is journalled within transmission housing 71 and a tension gear 87 is mounted to shaft 88 coplanar with gears 76 and 78 so that a chain surrounding gears 76, 78 and 87 will follow a triangular path. A transmission chain 77 encompasses gears 76, 78, and 87 to define a fixed speed ratio between gears 76 and 78, shafts 73 and 75, and upstream roller 72 and downstream roller 74.

Downstream drive gear 86 is mounted to downstream shaft 75 in transmission housing 71. A shaft bracket 81 is fixed to housing 71 and extends inwardly toward the axis of inner race 48. A drive shaft 83 is journalled to bracket 81 and extends into the plane of the inner race 48. A drive roller 82 is mounted on shaft 83 and contacts inner race 48. A drive gear 84 is mounted on shaft 83 coplanar with the downstream drive gear 86. A chain 85 connects gears 84 and 86. Therefore, the relative rotation of inner race 48 and dispenser barrel 50 wil' drive the drive wheel 82, the downstream roller 74, and the upstream roller 72 all to rotate in the same direction. The ratio of gears 84 and 86 is preferably 1:1 for the sake of convenience although other predetermined ratios may be utilized. As barrel 50 rotates, roller 82 will pass by roller 69. The width and position of the rollers 69 and 82 should be chosen so the rollers do not collide during rotation.

Figure 22:
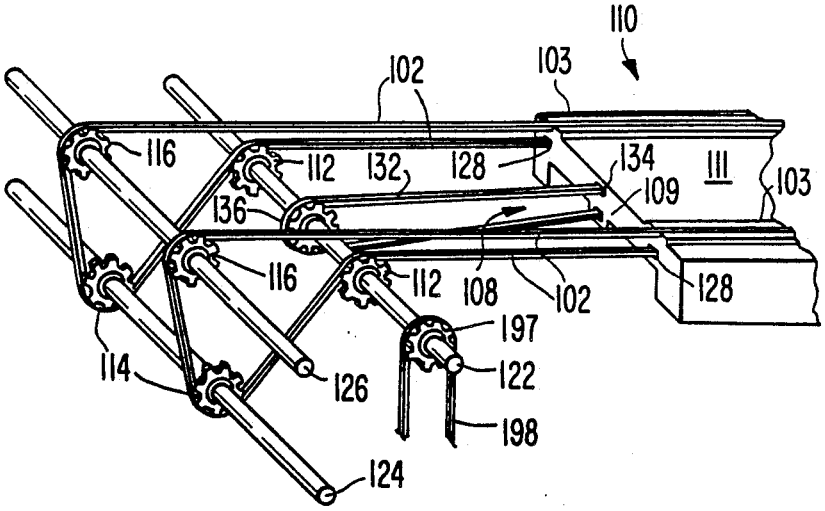
FIG. 22 is an isolated perspective view of a transmission for the wrapping conveyor of FIG. 2.
Figure 23:
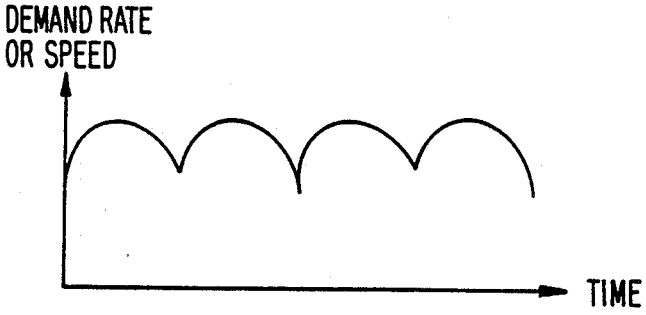
FIG. 23 is a graph of demand for film web.
Figure 24:
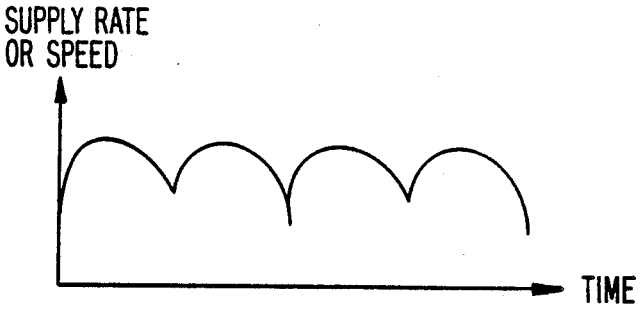
FIG. 24 is a graph of film web supply from the dispenser.
Figure 25:
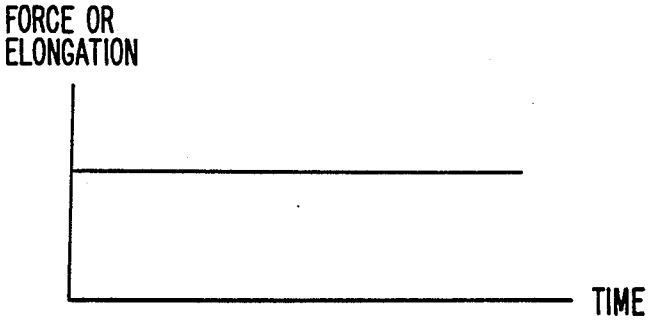
FIG. 25 is a graph of film web elongation under the demand shown in FIG. 23 and the supply shown in FIG. 24.

As shown in FIG. 13, free rollers 121, 122 and 123 are journalled to plate 79 and housing 71 adjacent the roller 72 and 74. As shown in FIG. 4, the film web 58 is drawn from film roll 56 across first free roller 121, then across the surface of downstream roller 72, and across second free roller 122 adjacent the space between roller 72 and 74, across the downstream roller 74, and across free roller 123 Film web 58 is drawn as far as the downstream roller 74 by the relative rotation of race 48 and barrel 50, and then across roller 123 to the applicator mandrel 180 by relative rotation of barrel 50 and the mandrel 180. All of the rollers 72, 74, 121, 122 and 123 rotate as the film web passes across them, and are parallel to the film roll 56 and the barrel tubes 53. A nonparallel angled free roller 124 may be mounted to hoops 52 and 54 adjacent free roller 123. Film web 58 passes from free roller 123 across roller 124 and then to the center of barrel 50 in the vicinity of bundle 40 and applicator mandrel 180. The angular placement of roller 124 advantageously enhances wrinkle-free application of the film web 58 at the mandrel. Roller 124 preferably is mounted so that the angle may be adjusted to obtain the optimal film condition. The stretched film web 58 is drawn during rotation of the dispenser barrel 50 to applicator mandrel 180 through which bundle 40 is transported during wrapping As shown in FIG. 22, the mandrel 180 comprises a film web transporter 108 beneath the bundle conveyor 110, and at least one film web transporter adjacent at least one additional side of the bundle such that two film web transporters carry the film web adjacent opposed surfaces of the bundle. Bundle conveyor 110 preferably includes one or more endless loop package chains 102 circulating around chain tracks 103. Chain tracks 103 are spaced sufficiently far apart in main plate 111 of conveyor 110 to avoid bundle spillage, and are preferably manufactured from a class of plastic substances known as ultrahigh molecular weight polyethylene. Chain tracks 103 expose the uppermost surfaces of chains 102 and support the lower surface of chains 102 against sag when a bundle 40 rests on chains 102. At a point upstream of dispenser barrel 50, each chain 102 circulates around a gear 112 mounted to an axle 122, then around a gear 114 mounted to an axle 124, and finally around a gear 116 mounted to an axle 126, before proceeding downstream to carry the bundle. Main plate 111 of conveyor 110 defines a throughgoing bore 128 beneath each track 103, through which the returning chain 102 passes to encounter gear 112.

Film web transporter 108 is positioned beneath the conveyor 110 and preferably includes an endless loop chain 132 circulating in a downstream direction in chain track 109 beneath the plate 111 and then returning in an upstream direction through a throughgoing bore 134 defined by plate 111. At the upstream end, chain 132 circulates around gear 136 mounted to axle 122. In this manner, the bundles 40 are carried on conveyor 110 synchronized at the same speed as the film web carried beneath conveyor 110 by transporter 108. This is accomplished by using identical gears 112 and 136 on shaft 122 to drive chains 102 and 132.

As shown in FIG. 2, conveyor 110 and transporter 108 may be driven by mounting gear 196 to axle 194 of motor 195. Gear 197 is mounted on axle 122. Chain 198 circulates about the gears 196 and 197, so that operation of the motor 195 will move the chains 102 and 132 which engage gears 112 and 136, respectively.

At the downstream end of the conveyor 110, each chain 102 passes across the end of track 103 and around a gear 130 mounted to freely rotate so that the chain 102 passes from the upper track 103 flowing in a downstream direction to the throughgoing bore 128 flowing back upstream, in the reverse direction. Chain 132 circulates about a gear, not shown, mounted to main plate 111 between the two gears 130. Wheels 200 are mounted downstream from gears 130 on plate 111 and rotate freely with gears 130 sufficiently below the upper surface of main plate 111 to avoid contact with the bottom of a bundle. In order to support the downstream end of conveyor 110 and film web transporter 108, the bottom edge of each wheel 200 is supported on roller 201 attached to the frame. Thus, the film web is carried downstream beneath main plate 111 by the lower exposed portion of chain 132. The film web does not encounter any opposition to this motion since the portions of chains 102 and 132 moving upstream are isolated within bores 128 and 134, respectively. When the film web transported by chain 132 encounters the wheels 200, it passes between the wheels 200 and the roller 201 and recovers against the bottom of the bundle downstream from the wheels and the roller.

Figure 21:
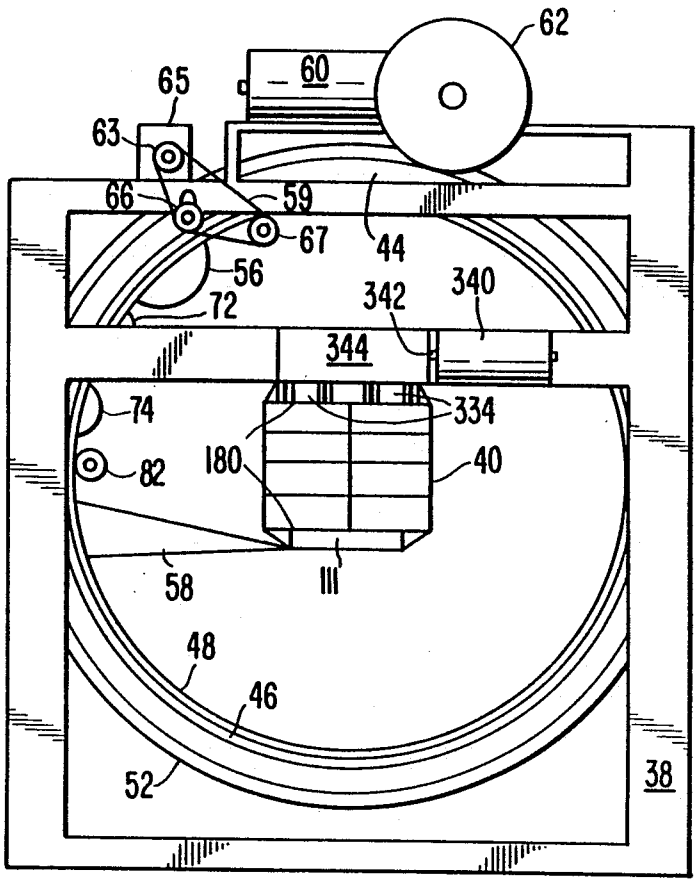
FIG. 21 is a front view of the applicator mandrel of FIG. 19.
Figure 19:
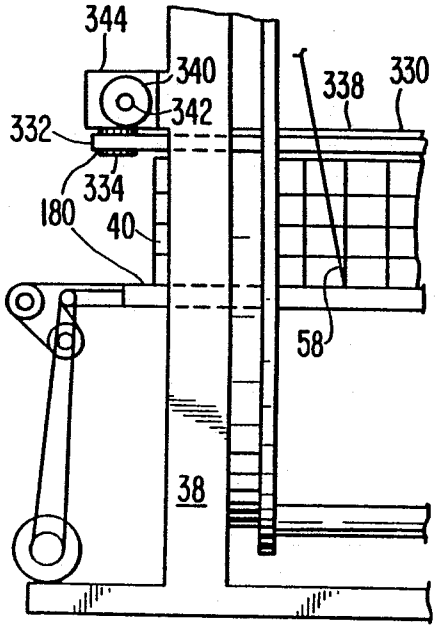
FIG. 19 is an isolated side view, upstream from the first wrapping stage, of an applicator mandrel configured for tall bundle contours.
Figure 20:
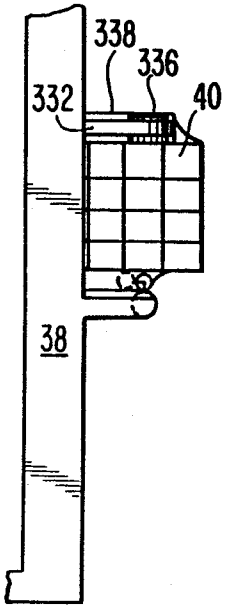
FIG. 20 is an isolated side view, downstream from the second wrapping stage, of the applicator mandrel of FIG. 19.

The applicator mandrel 180 includes a bottom film web transporter 108 and at least one other film web transporter which is adjacent at least one widest surface of the bundle in addition to transporter 108. If the widest bundle sides are vertical, then two parallel vertical transporters 210 are preferably utilized as shown in FIGS. 1 through 4. If the widest sides are horizontal, then one film web transporter 330 is placed atop the bundle and opposite transporter 108 as shown in FIGS. 19 through 21. Each film web transporter carries the film web 58 wrapped across the film web transporter in the downstream direction at the same speed as the bundle speed.

The film web transporters 108 also provide an effective increase in the wrapping radius perpendicular to the widest bundle surface. Thus, the difference between the vertical wrapping radius and the horizontal wrapping radius of an oblong bundle during wrapping is minimized by placement of the film web transporters so that the cross-section of the film web is supported on the mandrel is less oblong and more square than the bundle cross-section. The variation in elongation of the film web as the film web is wrapped across consecutive surfaces of the application mandrel 180 is more unified and is more easily maintained substantially in the linear wrap force range according to the present invention by this positioning of application mandrel 180. High containment force is obtained at the mandrel and ultimately at the bundle.

The applicator mandrel 180 preferably extends through both dispenser barrels 50. However, a first mandrel may extend within the first dispenser barrel and a second mandrel may extend within the second dispenser barrel. Alternatively, conveyor 110 and transporter 108 may extend through both barrels while film web transporter 210 or 330 are separately positioned in each barrel.

Certain types of bundles are extremely fragile and may require film web transporters which extend to cover the entire adjacent bundle surfaces for preventing the wrapped film web from imparting a substantial part of the wrap force on the bundle. However, for many other less fragile bundles, significant economy can be derived by covering only a portion of a bundle surface with a film web transporter, leaving the bundle edges exposed to encounter film web 58. Since the topmost lengthwise edges of the bundle are most prone to disalignment, film web transporters 210 or 330 preferably extend across bundle surfaces to a distance from bundle edges no greater than ½ of the height or width, respectively, of bundle units at each edge.

Figure 16:
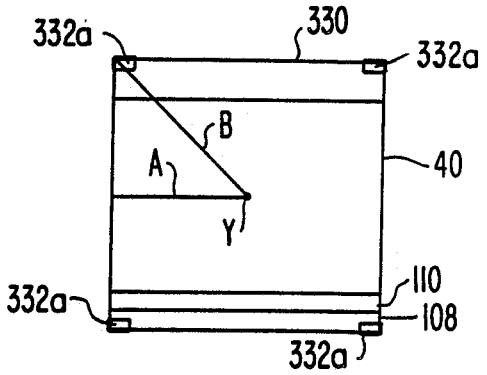
FIG. 16 is a schematic view of a bundle and an applicator mandrel spanning the full width of widest bundle surfaces.

The effect of this placement on film demand is shown in FIG. 16 in which a rectangular bundle with 10 inch vertical surfaces and 14 inch horizontal surfaces is placed between a top surface film web transporter 330 and the conveyor 110 and bottom surface film web transporter 108. For purposes of illustration, it is assumed that the film web transporters are 2 inches thick. At the downstream end of the transporters, the film web recovers to the top and bottom surfaces of the bundle, and the final circumference around the bundle is 48 inches.

With very fragile bundles, the film web transporters preferably extend across the full 14 inch width of the top and bottom bundle surfaces in the applicator mandrel. In this case, the mandrel wrapping circumference is 56 inches and the film web recovers by 16% to reach the final circumference of 48 inches at the downstream end of the applicator mandrel when it moves from the mandrel to the bundle. Furthermore, the maximum wrapping radius B is 9.9 inches and the minimum radius A is 7 inches, with a ratio of minimum to maximum of 0.71 and a difference of 2.9 inches. Thus, the placement of the film web transporters present a wrapping cross-section which reduces the range of elongation variance during wrapping of the applicator mandrel.

Figure 17:
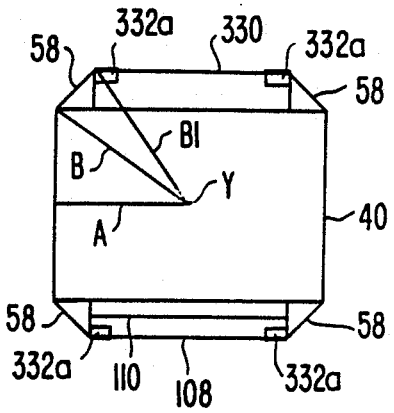
FIG. 17 is a schematic view of a bundle and an applicator mandrel spanning a portion of the width of opposed widest bundle surfaces.

As shown in FIG. 17, as preferred for somewhat less fragile bundles, the width of the film web transporters and conveyor is reduced to 10 inches to obtain an octagonal cross-section in the applicator mandrel for wrapping with both the bundle edges and the film web transporter edges encountering wrapped film web 58. The wrapping circumference of the applicator mandrel is then 51.3 inches, and the film web must recover only 6.9% to reach the final bundle circumference of 48 inches. The maximum wrapping radius is reduced to 8.6 inches, so that the minimum to maximum ratio is increased to 0.81 and the difference or range of radii is reduced to 1.6 inches. Thus it is apparent that a very modest reduction in the transporter width achieves significant improvement in final bundle force after recovery by the film web beyond the downstream end of the applicator mandrel, while simultaneously requiring a linear wrap force range of lesser width and permitting higher pre-stretch ratios. It is useful to reduce the width of each transporter so that its outermost edges are at a radius, or distance, from the center of dispenser rotation no greater than the distance from the dispenser rotation center to the bundle edges as shown in FIG. 17.

While those skilled in the art will recognize that the precise calculations will vary depending on the thickness of the film web transporter and the cross-section dimensions of the bundle, it can be seen that significant advantages are achieved in both final force and final film elongation by the present invention, which in turn reduces the operating consumption and total cost of the film web.

Figure 9:
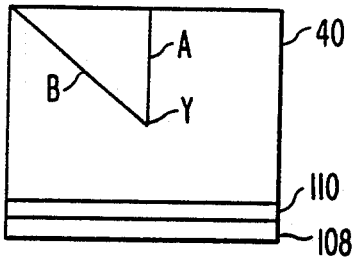
FIG. 9. (PRIOR ART)
FIG. 9 is a schematic view of a conventional wrapping conveyor and bundle.
Figure 10:
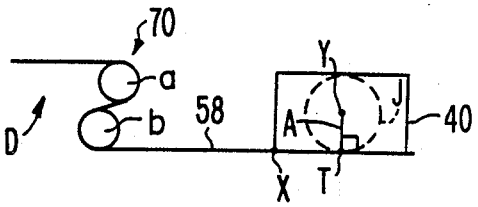
FIG. 10 is a schematic view of a prior art dispenser and bundle, illustrating a point of minimum demand for film web at the bundle.
Figure 11:
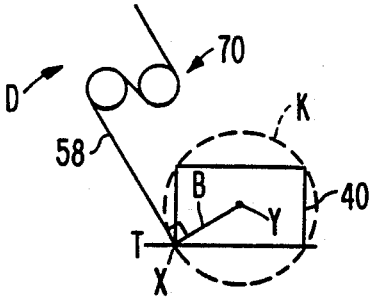
FIG. 11 is the schematic view of the bundle and dispenser at FIG. 10 at a later point in time, illustrating a point of maximum demand for film web at the bundle.
Figure 12:
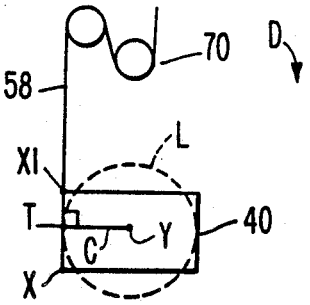
FIG. 12 is a schematic view of a dispenser apparatus and bundle of FIG. 11 at a later point in time, illustrating a point of secondary minimum demand for film web at the bundle.

As shown in FIG. 9, by comparison, the 10 inch by 14 inch bundle conventionally would be supported only by a 10-inch-wide conveyor 110 and bottom film web transporter 108. Presuming that the bottom supports 108 and 110 total 2 inches in height, that the bundle is centered and that the film web recovers between the dispenser and the bundle, then the maximum wrapping radius B is 9.2 inches while the minimum radius A is 6 inches for a ratio of 0.65 and a difference of 3.2 inches. The recovery at each side is thus at least 35% during wrapping and an additional 3.2% (49.6 inches to 48 inches) when the bundle exits the conveyor, with additional recovery between the pre-stretch subsystem and the bundle of 33% to 50%.

Generally, the width of the conveyor 110 may be reduced where the bundle rests in a tray during wrapping. This is often the situation when wrapping for example, cases of soft-drink cans or bottles, or where a single, relatively stiff unit comprises the bottom of any wrapping cross-section. In the illustrated mechanism, the mere use of chain as a minimum-width film transporter 108 presents a modest further reduction in final recovery at the end of application mandrel 180 but does not further decrease the range of wrapping elongation variance since the demand speed maxima and minima remain constant. The width of top film web transporter 330 may be reduced so that the edges of transporter 330 preferably span at least half of the width of outermost top bundle units in the horizontal direction transverse to the motion of the bundle. Likewise, the height of transporters 210 preferably spans at least half the height of outermost top bundle units.

Alternative film web transporters beneath the bundle are described in U.S. Pat. No. 4,317,322 assigned to Lantech, Inc. and incorporated by reference in this application.

FIGS. 2 through 4 show a film web transporter arrangement which is preferable when the wider side of an oblong bundle is vertical. Film web transporters 210 are positioned in close proximity or in contact with opposing widest surfaces, which are vertical, of the tall bundle 40. Each film web transporter 210 comprises a skid-sleeve 178 secured to the frame, and upstream double-sheave pulley 172 and downstream pulley 174 mounted at opposite ends of the skid-sleeve 178. A belt or chain 170 encircles one sheave of pulleys 172 and 174. Belt 170 circulates in a downstream direction toward pulley 174 while exposed at an upper edge of skid-sleeve 178 toward pulley 172. Upstream pulley 172 is preferably located upstream from the wrapping station 41, while the skid-sleeve 178 preferably extends downstream through and beyond the wrapping station. Generally, each skid-sleeve 178 extends vertically across an entire vertical face of bundle 40, but for sturdy bundles may be abbreviated to extend across merely a portion of the bundle face.

Transporter motor 162 is mounted to a lower portion of frame 38, and rotates motor shaft 164 about its axis. Shaft 164 extends outwardly on opposite sides of motor 162. Pulleys 168 are mounted to opposite ends of axle 164 below respective pulleys 172. Each pulley 168 and a second sheave of the respective pulley 172 are encircled by a vertical belt 169. Therefore, operation of motor 162 will drive the circulation of side conveyor belts 170. As the upper portion of each belt 170 moves downstream, it carries with it any film web 58 which may be wrapped around the skid-sleeve 178. The skid-sleeve 178 is preferably configured and composed of a material chosen for low friction with the film web 58.

FIGS. 19 through 21 show a film web transporter arrangement which is preferable when the wider side of an oblong bundle is horizontal. A top conveyor 330 is driven to carry film web 58 is wrapped along the top of the conveyor 330 in said downstream direction at the same speed as the bundle. The top conveyor 330 comprises belts or chains 332 rotating across upstream rollers 334 and downstream rollers 336, beneath conveyor support plate 338. The rollers 334 and 336 are journalled to the support plate 338. Support plate 338 extends upstream from the wrapping area and is fixed to the frame of the apparatus to support top conveyor 330. Motor 340 and dual output reducer 344 are mounted to frame 38 upstream of the wrapping area. Motor shaft 342 is coupled to reducer 344, and the output shafts of reducer 344 are coupled to rollers 334. Motor 340 will drive rollers 334 to rotate in opposite directions and move the outer portions of belts 332 downstream with the bundle.

Other greatly preferred film web transporter arrangements are shown in FIG. 16 and 17. Belts or chains **332*a* and 132*a* form the edge surfaces of the film transporters 108 and 330** to suspend the film web between them. This arrangement has proven especially useful in defining the mandrel for wrapping fragile bundles.

This construction allows the film web to be wrapped around a bundle 40 carried from the infeed conveyor 31 onto the wrapping station 41. The stretched web is initially wrapped around the bottom transporter 108 and either two side conveyors 210 or a top conveyor 330, with both the bundle and wrapped film web being carried by the conveyor assembly and transporters in the same direction. The film web applied to mandrel 180 forms a tube which moves off the downstream end of mandrel 180 and recovers, still under tension onto the bundle 40 emerging from within the mandrel. Even if the application mandel is wrapped with a very high wrap force, the uniform partial recovery of film web allows fragile bundles to experience balanced forces on opposing surfaces which are reduced from those on the application mandrel. This avoids bundle collapse which would have occurred using conventional arrangements at high wrap forces.

Figure 18:
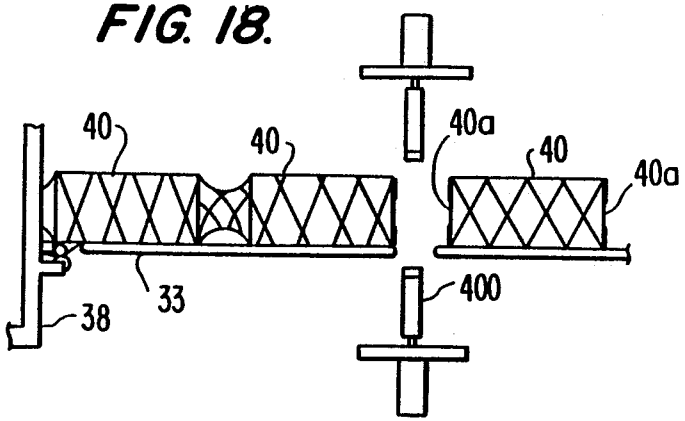
FIG. 18 is a schematic side view illustrating severance of continuously wrapped bundles.

As shown in FIG. 18, the bundles 40 preferably are spaced apart so that the continuous film web tube between consecutive bundles can be severed by any conventional cutting device 400 downstream of the mandrel 180. Continuously wrapped bundles are taken off of the apparatus and are severed into separate bundles on conveyor 33 away from the apparatus. According to the present invention, the film web tube portions extending before and behind bundles after severance promptly recover under tension against respective leading and trailing ends of the attached bundle to form tight bull's-eye patterns **40*a*** on the ends of the bundle. The containment force exerted on bundle ends is improved due to the higher force applied when the film web encompasses the bundles and the spaces therebetween.

Infeed conveyor 31 brings each bundle 40 onto conveyor 110 which then carries the bundle through each of the two wrap stations 41 within the applicator mandrel 180. At startup, the leading edges of the film webs 58 are held beneath transporter 108. One way to hold the webs at startup is to tie the leading end of the web 58 from stage 35 to the leading end of the web 58 from stage 36 beneath transporter 108. As shown in co-pending application Ser. No. 582,779, each dispenser 41 is positioned and arranged to orbit the applicator mandrel in a direction opposite that of the other dispenser 41, so that the two wrap patterns placed on each bundle will have opposite circular components due to the orbiting dispensers and identical linear components due to the motion of the mandrel and bundle.

As each barrel 50 rotates, film is drawn across the surface of downstream roller 74 to encircle the applicator mandrel 180. The rotation speed of roller 74 is proportional to the rotation speed of the race 44 and independent of the demand for film web 58 at the bundle If chain 77 engages gears 76, 78 and 87, then the rotation speed of upstream roller 72 is held to a constant ratio of that of downstream roller 74, so that upstream roller 72 draws film 58 from film roll 56. The film web is stretched both during passage between the rollers 72 and 74, due to their relative speed ratio, and between roller 74 and the applicator mandrel. Alternatively, roller 72 can be removed or allowed to freewheel by removing chain 77 or by disengaging gear 76 through a clutch mechanism so that no pre-stretch is exerted on web 58 but the web 58 is still drawn to and dispensed across roller 74 at a substantially constant supply speed and is stretched between roller 74 and the mandrel.

At the improved operating speed of barrel 50, which is typically 40 to 60 rpm, the high demand speed of film web 58 at mandrel 180 causes elongation of web 58 at the mandrel substantially beyond the yield point of the film web between the film web dispenser and the applicator mandrel. The stress-strain characteristics of the film web in this area are within the corresponding linear wrap force range The direction of the wrap force varies as the film web dispenser orbits the applicator mandrel 180. However, applicator mandrel 180, which includes conveyor 110 and transporter 108 in combination with transporter 330 or transporters 210, supports the bundle and resists the force from any of its directions.

Thus, the present invention achieves significantly increased operating speeds without compromising reliability or increasing the rate of failure of the film web. The film web remains intact even if a hole develops in the film web. This is because the controlled supply system will continue to dispense film independent of its being weakened by the hole. Thus, no dispenser or pre-stretch mechanism shut-down occurs.

After one wrap has been made around the mandrel 180, the leading edge of the web 58 is held firmly beneath the overlying web 58. A number of wraps are placed around the mandrel which carries the wrapped web and the bundle downstream. The combination of dispenser circular motion and mandrel/bundle linear motion creates a helical wrapping pattern with a first circular component at the first dispenser and a second circular component, opposite to the first, at the second dispenser. It should be noted that there is a space between the downstream end of applicator mandrel 180 at the second wrapping stage and the take-off conveyor 33 allowing the stretched film web to recover from the larger mandrel circumference to the smaller circumference of the bundle emerging from the mandrel, applying opposing forces simultaneously to opposite bundle sides. The reduction in web circumference is accompanied by a reduction in bundle force, thus avoiding the bundle crushing and the film web failure experienced at peak forces in the prior art.

In the continuous wrapping operation, the bundles are continuously carried along the wrapper conveyor assembly to the end of the applicator mandrel, and then onto take-off conveyor 33. The bundles are then severed between the spaced film areas as previously discussed and taken away to another transport area.

The present invention is directed toward a process which avoids the dilemma of simultaneous high-force hazards of film web rupture and low-force inefficiencies due to unreliable containment present in conventional wrapping systems. It does so by managing the supply speed and stress-strain characteristics of the film web and preventing the force on the film web from controlling the supply speed of the film web from the film web dispenser. The process markedly increases the final containment force of the film web on the bundle, reliably avoids both bundle failure and film web failure during wrapping, minimizes wrinkles in wide film web, and permits operation at higher throughput and film web speeds than previously possible in conventional systems.

In accordance with the present invention, there is provided a process for wrapping a bundle 40 with the film web 58 dispensed from a film web dispenser 70 comprising moving the bundle 40 into an applicator mandrel 180, revolving the film web dispenser 70 relative to the applicator mandrel 180, dispensing the film web 180 from the film web dispenser 70 onto the applicator mandrel 180 at a constant supply speed, transporting the film web 58 wrapped around the applicator mandrel 180 beyond the downstream end of the applicator mandrel 180, continuing moving the bundle 40 beyond the downstream end of the applicator mandrel, and applying the film web 58 from the applicator mandrel 180 onto the bundle 40 so as to provide a containment force in the film web 58 after it has been applied onto the bundle 40.

The supply speed of the film web at the film web dispenser is preferably prevented from increasing by restraining and retarding the film web being dispensed by the film web dispenser at a dispenser supply speed less than the lowest demand speed at the applicator mandrel.

According to the present invention, the film web is stretched between the film web dispenser and the applicator mandrel. Such stretch can be identified by observing a film web marked at regular intervals which are spaced farther apart on the wrapped objects such as the applicator mandrel than between the pre-stretch rollers in the film web dispenser.

Figure 5:
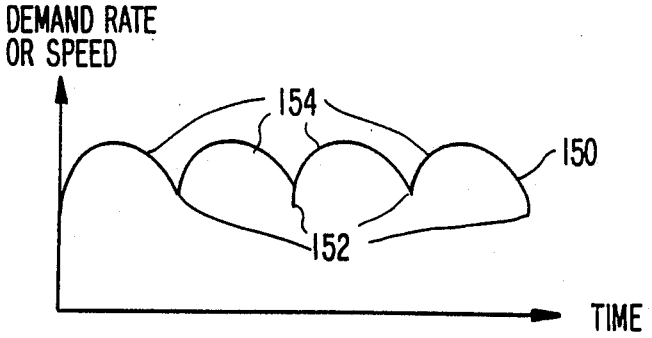
FIG. 5 is a graph of demand for film web at a wrapped rectangular applicator mandrel of the present invention.

FIG. 5, shows that the speed of film take up or demand at the wrapped object indicated by the curve 150, varies as the barrel 50 rotates about the rectangular mandrel 180 and bundle 40. In particular, a minimum point 152 occurs as each edge is encountered and is followed by a maximum point 154.

Figure 6:
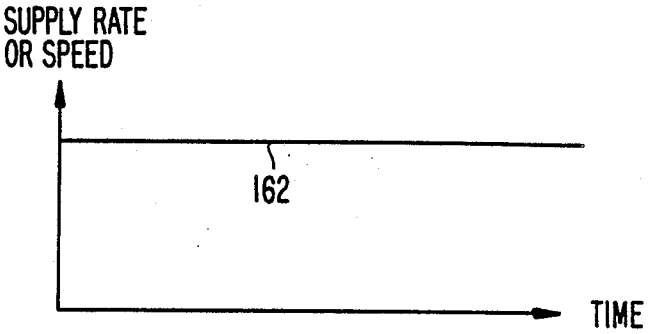
FIG. 6 is a graph of film web supply from the dispenser of the present invention.

FIG. 6 illustrates a film payout speed or supply function, indicated at 162, which is exhibited by the present invention at the downstream roller 74 of the film web dispenser. This shows that the supply function is substantially constant or flat even at the high speeds of operation. Regardless of the demand for film at the bundle, the supply speed of film at the downstream roller 74 is controlled so as to remain constant while barrel 50 and race 48 each operate at constant speed.

Figure 7:
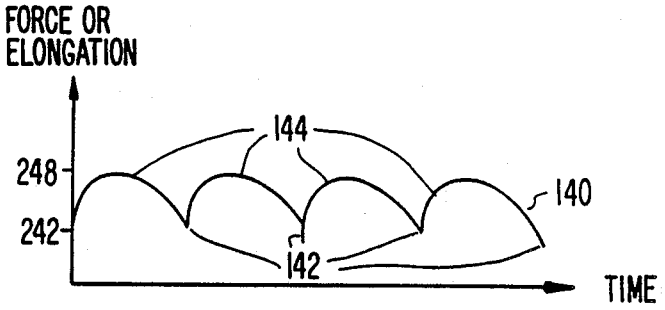
FIG. 7 is a graph of film web elongation exerted between the dispenser and the applicator mandrel of the present invention; based on the demand shown in FIG. 5 and the supply shown in FIG. 6.
Figure 8:
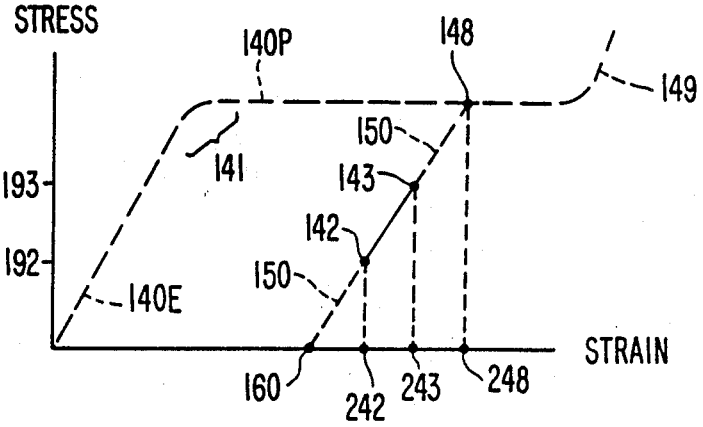
FIG. 8. (PRIOR ART)
FIG. 8 is a graph illustrating the relationship of force and elongation in conventional wrapping processes.

FIG. 7 illustrates a curve of the force and elongation of the film web on the bundle in which film web force and elongation is locked in at each bundle edge at each minimum point 142 below the prior maximum point 144 where elongation was greatest. In conventional bundlers, elongation at the wrapped object fluctuated in a similar pattern. However elongation was always less than pre-stretch elongation. Also, the maximum force corresponding to point 144 was always reduced by the mechanical advantage or motor torque of the pre-stretch devise to a force substantially less than the force exerted on the film web between the pre-stretch rollers.

In accordance with the present invention, the film web is stretched beyond its yield point to plastically deform the film web between the film web dispenser and the applicator mandrel throughout the revolution of the film dispenser about the applicator mandrel It is further in accordance with the present invention to maintain the film web between the film web dispenser and the applicator mandrel in the linear stress-strain range beyond the yield point throughout the revolution of the film dispenser wherein the film web stress undergoes minimal variation while film web strain undergoes comparatively greater variation throughout the revolution of the film dispenser while the film web is positioned between the film web dispenser and the applicator mandrel.

In accordance with the present invention, if the bundle is substantially oblong in cross-section, the film web is prevented from substantial pre-stretching prior to dispensing the film web from the film web dispenser. However, with bundles less oblong in cross-section, the film web is pre-stretched beyond its prestretch yield point to plastically deform the film web in the film web dispenser prior to subsequently post-stretching the film web beyond its post-stretch yield point to further plastically deform the film web between the film web dispenser and the applicator mandrel.

Figure 14:
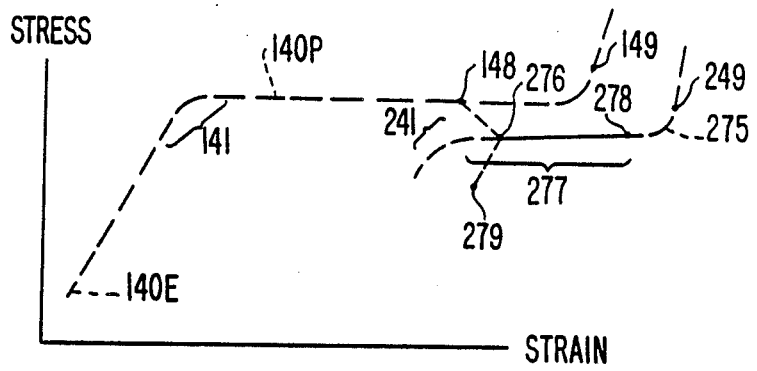
FIG. 14 is a graph illustrating the relationship of stress and strain on the film web when pre-stretched in the film web dispenser and stretched again at the applicator mandrel of the present invention.

When initial stretch beyond the pre-stretch yield point range of 141 of film web 58 is isolated between upstream roller 72 and downstream roller 74, secondary stretch between the downstream roller and the applicator mandrel causes the film web 58 to follow a force-elongation curve 275, illustrated in FIG. 14. This curve exhibits a secondary linear wrap force range 277 between the secondary yield point range 241 and the break point 249. The secondary yield point 241 is found at elongations and forces slightly lower than at pre-stretch operating point 148, and increases when pre-stretch elongation is increased. The range 277 generally is found at higher elongations and lower forces than the pre-stretch operating point 148. The present invention preferably utilizes a portion of the linear wrap force range 277 exemplified by the minimum 276 and maximum 278. Force and elongation are locked in at minima 276 and, as the bundle and film web moves beyond the applicator mandrel, recovery produces a bundle force and elongation at recovery point 279, well above the final force and elongation at point 142 which was that at which conventional processes operated.

Figure 15:
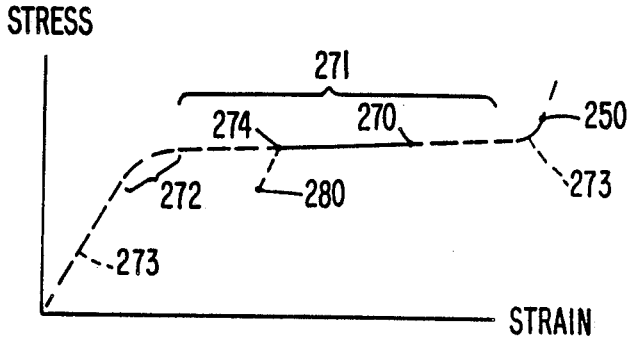
FIG. 15 is a graph illustrating the relationship of stress and strain on film web stretched between the dispenser and the applicator mandrel of the present invention.

. To perform the process of the present invention without prestretching the film web, upstream roller 72 is allowed to freewheel by removing chain 77 or otherwise decoupling gears 76 and 78 in any well-known conventional manner. Alternatively, roller 72 could be removed. This results in a different stress-strain relation on the film web between the downstream roller 74 an application mandrel 180. In accordance with the present invention, if the film web is stretched only between downstream roller 74 and applicator mandrel 180 its stress-strain relationship is shown in FIG. 15 as curve 273. This curve exhibits a broad yield point region 272 followed by a broad linear wrap force range 271 during which plastic deformation occurs in the film web. This linear wrap force range is broader than the linear wrap force range 277 for pre-stretched film.

In this non-pre-stretched situation, where initial stretch occurs over a long film path, the web width is reduced considerably during stretch between the dispenser and applicator mandrel 180. This phenomenon is known as neckdown. Neckdown can be sharply inhibited by pre-stretching the film web between closely spaced rollers prior to wrapping the film web on applicator mandrel 180. The force level or stress in range 271 is generally lower than at pre-stretch film webs in pre-stretch operating point 148 or range 277. The linear wrap force range 271 extends between the broad yield point range 272 and the break point 250 over a wider variation of strain elongation. Yield point range 272 occurs at a slightly lower strain elongation and force level or stress than the pre-stretch yield point 141 between rollers. According to the present invention, it is preferable that in the non-pre-stretch embodiment, elongation is varied between exemplary maximum 270 and minimum 274 as each side of the applicator mandrel is wrapped. Force and elongation are locked in at each minimum 274. As the bundle and the web move beyond the applicator mandrel 180, recovery of the film web onto the bundle produces film web stress-strain conditions at point 280. While strain elongation at point 280 without pre-stretch may or may not be as great as that of conventional processes, depending on the contour of the applicator mandrel, containment force of the film web on the bundle 40 is significantly improved.

According to the present invention, the film web is dispensed from downstream roller 74 at a constant supply speed. Downstream roller 74 of the film web dispenser and thus the film web is restrained sufficiently below the lowest takeup or demand speed at applicator mandrel 180 to apply stretch to the film web between the dispenser and the mandrel substantially within the gentle sloped linear wrap force ranges 271 or 277 of the respective curves 273 and 275, depending on whether or not the film is pre-stretched. Due to the gentle slope of the curve in this range, the mandrel 180 as well as the film web and thus the film web dispenser experiences a substantially constant wrap force regardless of variation in elongation due to the varying demand for film web as it crosses the mandrel edges during wrapping. The applicator mandrel then releases the film web to encompass each bundle at a non-crushing bundle containment force lower than the wrap force on the mandrel due to the decrease in cross-section from mandrel to bundle.

As the initial pre-stretch ratio exerted between upstream roller 72 and downstream roller 74 is increased, the stress force level of the secondary linear wrap force range 277 will increase, neckdown of the web between the downstream roller and the mandrel will decrease, and the span of secondary elongation within the range 277 will decrease. Conversely, reduction of the pre-stretch ratio will decrease the secondary constant wrap stress force level, increase neckdown, and increase the "width," or range of stretch, of the linear wrap force range 277. Therefore, the process is preferably used at lesser pre-stretch when wrapping wider or taller mandrels and delicate bundles that require low force. The rotation rate of inner race 48 is adjusted in order to raise or lower the supply speed of the film web, in order to accommodate a change in demand rate for bundles of a different shape or size. It may also be necessary to configure the applicator mandrel to extend entirely across bundle surfaces of delicate bundles, so that the mandrel incurs a large portion of the wrap force.

While the use of pre-stretched film web is more economical, film web with little or no pre-stretch may be useful where the oblong bundle configuration causes extreme web takeup speed variations. In such situations, the wide linear wrap force range 271 of stretch of non-pre-stretched film web accommodates the takeup speed variations.

Certain types of bundles show extreme differences in height relative to width. These include both extremely tall bundles and extremely wide bundles. Such bundles exhibit the most extreme variations in web takeup speed and require the widest linear wrap force ranges 277 or 271. An ideal bundle without stretch variation would offer a circular wrapping cross-section centered on the axis of revolution of the dispensers. Among rectangular bundles, a square cross-section centered on the axis of revolution of the dispensers exhibit minimal variations in takeup speed and secondary stretch. According to the present invention, the wrapping cross-section experienced by the film web is modified in order to minimize differences between height and width, and thereby minimize fluctuations in elongation above the yield point. At the same time, this system advantageously prevents disruption of the multi-unit bundle by the high, though constant, wrap force.

Cross-section adjustment is accomplished by placement of applicator mandrel 180 in the wrapping area surrounded by barrel 50, preferably centered on the revolution axis of race 44.

One way to confirm that the system is stretching the film web in its linear wrap force range between the dispenser and the applicator mandrel is to establish the stress-strain curve of the film web by dispensing the film web through a load cell between the dispenser and the applicator mandrel while observing the elongation of the film web. After knowing the range of the linear wrap force region of the curve, the controls of the dispensing mechanism can be set to provide the stress and strain on the film web necessary to place it in the linear wrap force region.

In accordance with the present invention, this system of stretching provides higher final stretch, higher bundle containment force on the film web, higher throughput, and use of less uniform film while preventing film web breakage than were previously through possible. Such web stretch at the wrapped object, as opposed to web recovery minimizes wrinkles in a wide web, conserves film by establishing containment with fewer web layers, and provides a tight bull's-eye in the film web at the ends of the bundle.

In accordance with the present invention, the film web is pre-stretched in the film web dispenser at a sufficient pre-stretch force and mechanical advantage so that it is beyond its pre-stretch yield point and subsequently further elongated by post-stretching the film web between the film web dispenser and the applicator mandrel beyond its pre-stretch yield point at a post-stretch force which is less than the pre-stretch force and greater than the pre-stretch force reduced by the mechanical advantage of the pre-stretch system. It is preferable to maintain the film web beyond its post-stretch yield point throughout the revolution of a film dispenser while the film web is positioned between the film web dispenser and the applicator mandrel. Under these conditions, the present invention avoids the overrun condition which occurs in conventional pre-stretch dispensing systems when the wrap force exceeds the pre-stretch force reduced by the mechanical advantage.

As shown in FIG. 26, the supply speed control mechanism of the present invention prevents the supply speed of the film web from increasing and also prevents the supply speed of the film web from decreasing. This is accomplished by using a motor driving the rollers of pre-stretch device which is controlled by a speed control device with regenerative capabilities which can prevent the speed of the motor from increasing as well as decreasing. Although motor controllers with regenerative capabilities are known in the motor control art, conventional wrapping devices did not have a control which prevented the supply speed from increasing, but rather only had a control that prevented the supply speed from decreasing. A motor control with regenerative capabilities would be known in the motor control art as a two quadrant controller since it could drive or retard a motor in a controlled fashion which is turning in a positive forward direction. Motor control used on conventional wrapping devices would be known in the motor control art as a single quadrant controller since it could only drive, and not retard, a motor in a controlled fashion which is turning in a positive forward direction.

The positioning of the applicator mandrel according to the teachings of the present invention accomplishes many of the objects of the present invention. Since the film is wrapped around the applicator mandrel, higher film force may be used to prevent crushing, twisting, dislodging or shifting which would occur in conventional arrangements. According to the present invention, when the film web tube formed on the applicator mandrel is released to surround each bundle it is done so by contacting the bundle on opposing surfaces simultaneously rather than exerting force on single bundle edges and sides so that wrap forces are mutually opposing and balanced. Also according to the invention, by suspending the film web on an applicator mandrel, forces are locked in on the film web on different sides of the applicator mandrel. Transferring the film web in its suspended state from the applicator mandrel to the bundle, the film web reduces the difference between the locked in forces on its sides, therefore retaining more even locked in containment forces on the various sides of the bundle. This is especially true when either or both the bundle and the applicator mandrel have oblong cross-sections.

Considerations of dislodging, crushing, and good containment characteristics of a film web at the end of the wrap bundle, such that a tight bull's-eye is provided, it is especially important when wrapping a bundle having a plurality of bundle units. According to the invention, it is preferable in such circumstances to position the plurality of bundle units to form a bundle having as square a cross-section as possible.

In accordance with the present invention, problems with grossness of load and point source loading which have a tendency to rupture the film web in conventional systems, are prevented through the uniformity and controllability of the shape of the applicator mandrel. Further, the surface of the applicator mandrel is such that a substantially uniform force is applied across the full width of the film web while dispensing the film web onto the applicator mandrel. Although the applicator mandrel may contain linear edge lines in some embodiments, there are no corners, which would otherwise be present from the bundle which give rise to destructive point source loading at high wrap forces.

In addition, in accordance with the present invention, the grossness of load problems are solved by wrapping bundles of a sufficiently small size such as those that can be grasped and carried by a person and constitute a unit of a pallet load, and such as bundles in which the greatest cross-sectional measurement is not substantially greater than two feet square. Also in accordance with the present invention, bundles of uniform cross-section are used when continuously wrapping bundles with a system such as the dual stage orbiting dispensers.

According to the present invention, high throughput is possible since the film web dispenser can be revolved around the applicator mandrel and the bundle above the 25 revolutions per minute previously thought to be a maximum while using conventional systems. According to the present invention, the film web dispenser is revolved around the applicator mandrel on the bundle at a rate of at least about 30 revolutions per minute and is preferably operated in a range of about 40 to 60 revolutions per minute.

Additional advantages and modifications will readily occur to those skilled in the art. The invention in its broader aspects is, therefore, not limited to the specific details, representative apparatus and illustrative examples shown and described. Accordingly, departures may be made from such details without departing from the spirit or scope of applicants general inventive concept.

What is claimed is:

1. An apparatus for stretch wrapping a bundle with a film web dispensed from a film web dispenser comprising:

a film web dispenser for dispensing a film web;

means for maintaining a substantially constant supply speed of the film web at the film web dispenser by preventing the supply speed of the film web at the film web dispenser from increasing and preventing the supply speed of the film web at the film web dispenser from decreasing;

an applicator mandrel having a noncircular cross-section;

means for revolving the film web dispenser relative to the applicator mandrel to wrap the film web onto the applicator mandrel;

means for moving a bundle through the applicator mandrel;

means for transferring the film web from the applicator mandrel onto the bundle so as to provide a containment force in the film web after it is applied onto the bundle.

2. The apparatus of claim 1 wherein the maintaining means includes a motor and a motor controller having regenerative capabilities.

3. The apparatus of claim 1 including means for prestretching the film web in the film web dispenser.

4. An apparatus for stretch wrapping a bundle with film webs dispensed from film web dispensers comprising:

a first film web dispenser for dispensing a first film web and a second film web dispenser for dispensing a second film web;

means for maintaining a substantially constant supply speed of the film webs at the film web dispensers by preventing the supply speed of the film webs at the film web dispensers from increasing and preventing the supply speed of the film webs at the film web dispensers from decreasing;

an applicator mandrel having a noncircular cross-section;

means for revolving the first film web dispenser relative to the applicator mandrel in a first circular direction and for revolving the second film web dispenser relative to the applicator mandrel in a second circular direction opposite the first circular direction to wrap the first and second film webs onto the applicator mandrel;

means for moving a bundle through the applicator mandrel;

means for transferring the film webs from the applicator mandrel onto the bundle so as to provide a containment force in the film webs after they are applied onto the bundle.

* * * * *